United States Patent [19]

Porel

[11] Patent Number: 4,629,400

[45] Date of Patent: Dec. 16, 1986

[54] HYDRAULIC PUMP WITH PISTONS AND CONTROLLED SUCTION VALVES

[75] Inventor: Louis-Claude Porel, Rambervillers, France

[73] Assignee: Hydro Rene Leduc, France

[21] Appl. No.: 676,002

[22] Filed: Nov. 29, 1984

Related U.S. Application Data

[63] Continuation-in-part of Ser. No. 209,220, Nov. 21, 1981, Pat. No. 4,486,152.

[30] Foreign Application Priority Data

| | | | |
|---|---|---|---|
| Nov. 26, 1979 | [FR] | France | 79 29037 |
| Apr. 30, 1980 | [FR] | France | 80 09780 |
| Oct. 19, 1984 | [FR] | France | 84 16051 |

[51] Int. Cl.[4] ..... F04B 1/26; F04B 1/18; F04B 39/08

[52] U.S. Cl. ..... 417/270; 417/510; 417/515; 137/624.13

[58] Field of Search ..... 137/522, 624.13; 251/82; 417/269, 270, 510, 515, 506, 443

[56] References Cited

U.S. PATENT DOCUMENTS

| | | | |
|---|---|---|---|
| 744,916 | 11/1903 | Holdworth | 417/510 |
| 861,213 | 7/1907 | Homersham | 417/443 |
| 2,001,336 | 5/1935 | Vago et al. | 417/506 |
| 2,131,749 | 10/1938 | Ofoldt | 417/515 |
| 2,131,857 | 10/1938 | Lauret | 417/270 |
| 2,997,956 | 8/1961 | Stewart | 417/269 |
| 4,236,881 | 12/1980 | Pfloger | 417/510 |

FOREIGN PATENT DOCUMENTS

| | | | |
|---|---|---|---|
| 989095 | 9/1951 | France | 417/270 |
| 581735 | 10/1946 | United Kingdom | 417/269 |

*Primary Examiner*—William L. Freeh
*Attorney, Agent, or Firm*—Darby & Darby

[57] ABSTRACT

A hydraulic pump comprising at least a reciprocating piston, each piston being associated with one suction valve returned to its closing position by a return spring. The return spring is associated on the one hand with the valve and on the other hand with a push-piece cyclically actuated by a cam driven by the pump driving shaft in such manner that the action of the spring on the suction valve is cancelled during the suction phase and reestablished at the end of the suction phase.

5 Claims, 4 Drawing Figures

1
2
2a
3
4
5
6
7
8
9
10
11
12
13
14
15
16
17
18

HYDRAULIC PUMP WITH PISTONS AND CONTROLLED SUCTION VALVES

This application is a continuation-in-part of U.S. patent application Ser. No. 209,220, filed Nov. 21, 1981, now U.S. Pat. No. 4,486,152, issued Dec. 4, 1984 for PUMP WITH SPRING LOADED VALVE, which is incorporated by reference herein.

BACKGROUND OF THE INVENTION

1. Field of the Invention

The present invention relates to improvements to hydraulic pumps with pistons and controlled suction valves.

2. Description of the Prior Art

Generally, hydraulic pumps with pistons are comprised of a plurality of pistons reciprocated by means of a cam. The cam can be connected to the driving shaft, the pistons sliding in cylinders formed in the pump body, or the cam being fixed and the pistons sliding in cylinders formed in a rotary barrel driven by the driving shaft.

In these types of pumps, it is known to use hollow pistons through which the pumped hydraulic liquid flows, the hydraulic liquid penetrating inside the piston via the head of the latter and exiting therefrom at its other end. In such a case, the pistons rest on an inclined face of the cam via pads sliding on the surface of the cam, the pads being formed with a central orifice extending through them and coming to ride, during their suction stroke, on a lunula engraved on the surface of said cam. When the pad thus slides above the lunula, a fluid communication is established between the chamber in which moves the cam and the inside of the corresponding hollow piston via the lunula, the central orifice of the sliding pad and the piston head, also formed with a central orifice extending through it. This communication is interrupted when the pad leaves the lunula and slides on the smooth face of the cam. The liquid contained inside the piston and compressed by the motion of the latter is then discharged via a spring loaded valve located at the bottom of the cylinder.

The cam may be of any appropriate shape, for example an eccentric, whereby the pistons are radial, or a slanting plate, whereby the pistons are then parallel to the pump driving shaft.

Pumps of these types have two disadvantages. The first disadvantage is caused by the fact that the rotation direction of the pump driving shaft must always be the same, since otherwise suction and discharge cannot take place. In order to remedy this disadvantage, French Pat. No. 67/18715, dated June 17, 1977, has proposed to place on the front face of the slanting plate, without lunula, a plate pivotable over 180°, the plate being in turn provided with a lunula. Thus, by simply rotating the plate on the front face of the slanting plate it is possible to reverse the suction and discharge phases and therefore to reverse the pump rotation direction. Unfortunately, this rotation of the plate on the slanting face cannot take place automatically and requires manual intervention.

The second disadvantage arises from the fact that since the hydraulic liquids have non-negligible compressibility at high pressures (200 bars and above), it is necessary to angularly offset the beginning of the lunula with respect to the line of steepest slope of the slanting plate face in order to avoid the hydraulic fluid admission phase beginning before the hydraulic liquid inside the piston has finished expanding. If such a precaution is not taken, the liquid under pressure is discharged in the suction circuit, insted of the discharge circuit thereby lowering the pump efficiency. The degree of the offset is a function of the pump rotation speed and of the compressibility rate of the fluid transported. The latter depends on the pressure, temperature, quantity of air dissolved in the fluid, etc. Thus, it should be necessary to adapt the offset to the variations of the various variables. It has not, however, been known how to provide pumps in which the angular offset of the lunula can be modified at will. Therefore, a medium value of the offset is therefore determined, which is a compromise between the extreme values of the pump operation parameters. The result is that the pump operates in an optimum manner only under very aleatory conditions.

In order to mitigate these disadvantages, the applicant has replaced the feeding system by means of a lunula and sliding pads by suction valves.

In order that a pump equipped with suction valves (instead of a lunula such as hereabove described) may operate correctly and rotate at a high speed, the suction valves must return very quickly to their closed position. Thus are avoided phenomena of rebound, poor closing and interference with the discharge phase of the pump.

In order that the suction valves return quickly and correctly to their closed position, it is necessary that they be pushed by strong springs. But then, during the suction phase, the piston must overcome the strong effort applied to the suction valve. Generally, its suction power is not compatible with the valve return effort. The suction does not take place and the pump does not operate. Even if a compromised return-suction power is reached, the suction power of the piston is affected, at least of the value of the suction valve load. Therefore, the pump loses a major portion of its volumetric performance.

To solve this difficulty, the applicant has disclosed in U.S. Pat. No. 4,486,152 which has been incorporated by reference herein, a slanting plate pump having for each piston an admission valve subjected to the action of two antagonistic springs: a first spring pushing it in the closing direction and a second spring pushing it in the opening direction. The second spring is associated with a cam rotatably connected with the pump driving shaft so that the force exerted by the second spring becomes substantially equal to that exerted in the reverse direction by the first spring at the beginning of the suction phase. The application also discloses a cam formed such as to be placed in two positions offset by 180° with respect to one another, thereby allowing reversing of the pump rotation direction.

This arrangement operates satisfactorily, but its disadvantage is that it is rather complex and therefore costly, and the present invention relates to a simplified device that achieves the samd advantages.

In accordance with an illustrative embodiment demonstrating features and advantages of the present invention, there is provided a pump having at least a piston, each piston being associated with a suction valve, the valves being returned to their closing position by a spring, wherein the return spring of the suction valve is associated on the one hand with the valve and on the other hand with a push-piece cyclically actuated by a cam driven by the pump driving shaft, in such manner that the action of the spring on the valve is cancelled at the beginning of the suction phase and reestablished at the end of the suction phase.

BRIEF DESCRIPTION OF DRAWINGS

By way of a non-limiting example and for a better understanding, the present invention will now be described in more detail with reference to the accompanying drawings wherein.

DETAILED DESCRIPTION OF THE INVENTION

Figures 1, 2:
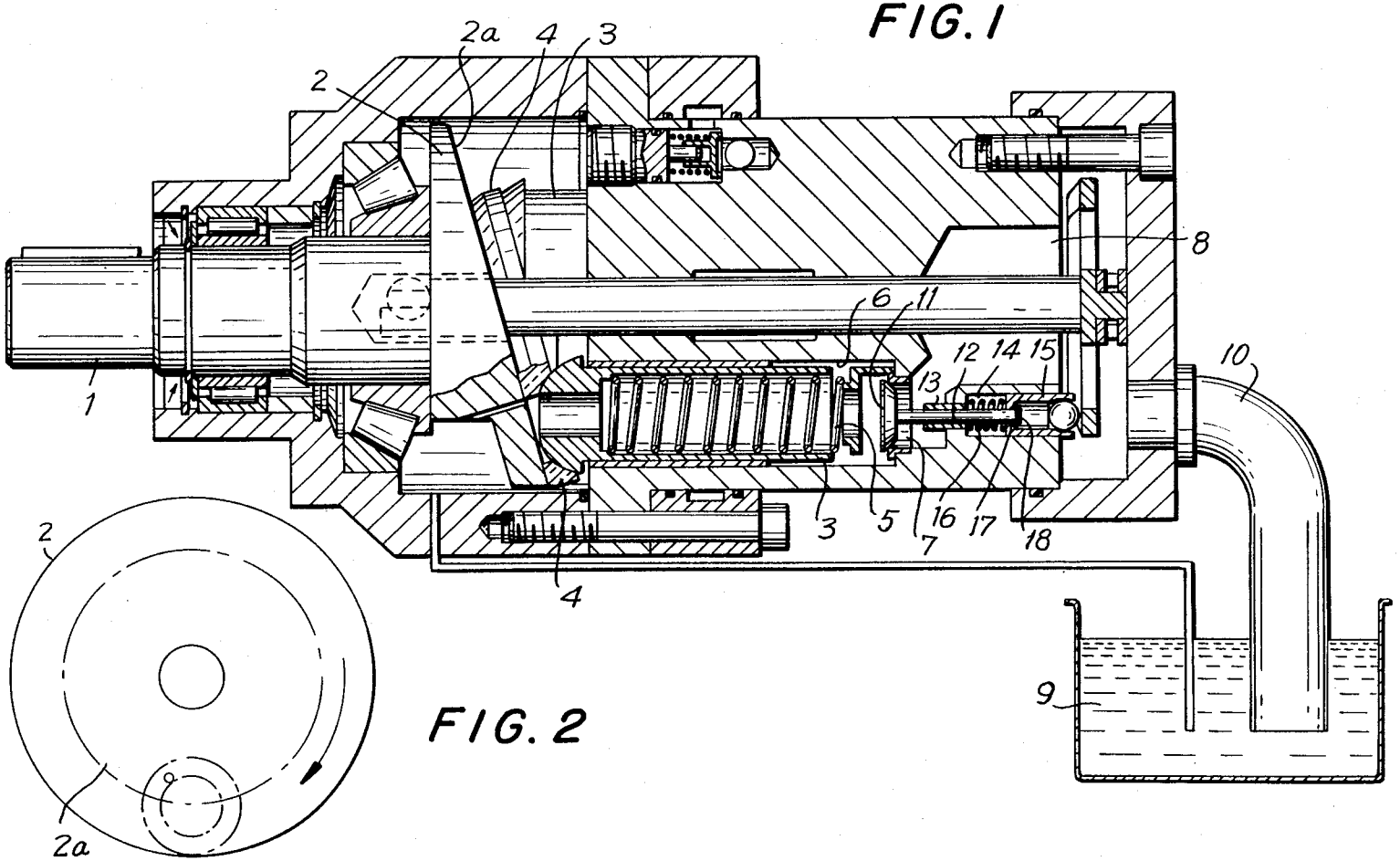
FIG. 1 is a longitudinal sectional schematic view of an embodiment of the invention.
FIG. 2 is a partial front view of FIG. 1 showing the front face of the slanting plate.

FIG. 1 shows a hydraulic pump with axial pistons and a slanting plate. The pump includes a driving shaft 1 carrying a slanting plate 2, on the front face *2a* of which rest a plurality of pistons 3, each piston 3 sitting against front face *2a* of slanting plate 2 via a sliding pad 4. Each piston 3 is maintained resting on its pad 4 by a spring 5 and moves in a cylinder 6. Each piston 3 is maintained resting on its pad 4 by a spring 5 and moves in a cylinder 6. Each cylinder 6 communicates via an orifice 7 with an admission chamber 8 which, in turn, communicates with tank 9 via a channel 10.

Figure 3:
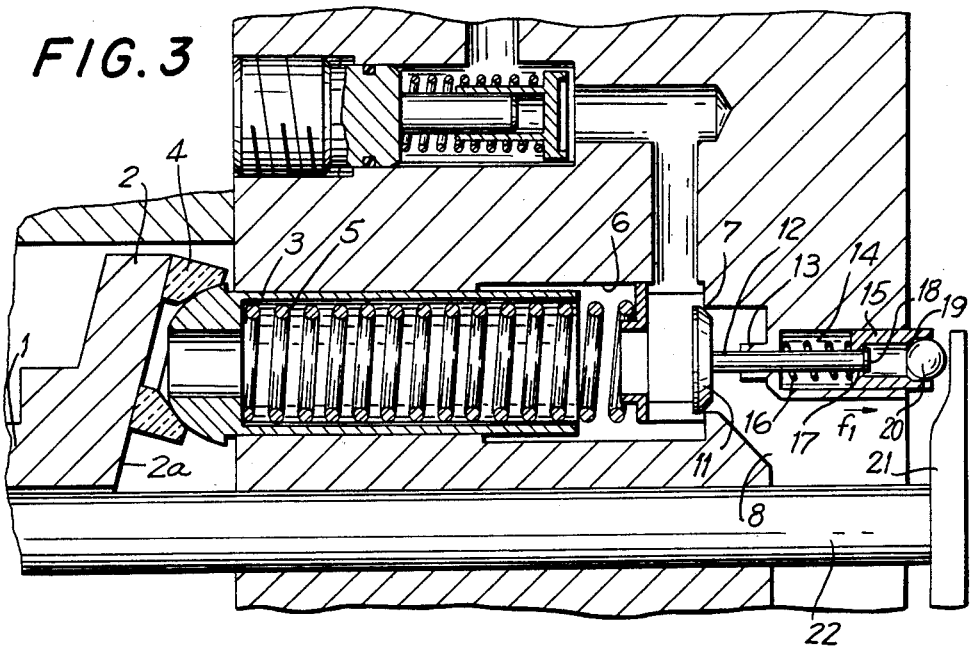
FIG. 3 is a partial view of FIG. 1 in a larger scale and showing the suction valve in a closed position.
Figure 4:
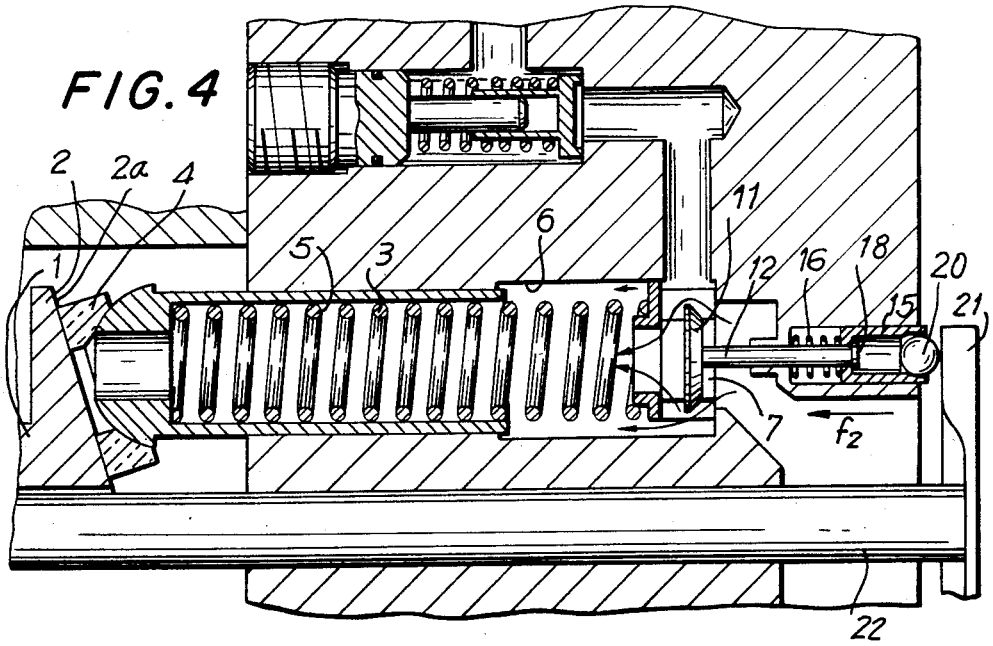
FIG. 4 is the same view as FIG. 1 showing the suction valve in a free opened position.

Each orifice 7 is equipped with a suction valve 11. Each valve 11 comprises a stem 12 sliding freely in a bearing 13 and extending into a bore 14 inside which can slide a hollow piston 15 returned by a spring 16. Stem 12 of valve 11 extends inside the hollow piston 15 via an orifice 17 in which it slides. At its end, stem 12 of valve 11 is formed with an abutment 18 which, in FIG. 1, is formed of a circlip and which, in FIGS. 2 and 3, is schematically shown by a disc rigidly connected to the end of stem 12. Thus, when spring 16 returns piston 15, the latter entrains stem 12 of valve 11 via an abutment 18 in the direction shown by arrow $f_1$, thereby causing the closing of orifice 7 by valve 11 (FIG. 2).

At the rear end of piston 15 is formed a housing 19 in which is disposed, with a clearance, a ball 20 bearing against a cam 21 carried by a rod 22 entrained by shaft 1.

Referring to FIG. 3, one sees that when rotating, cam 21 forces ball 20 back in the direction shown by arrow $f_2$ which reaches the bottom of its housing 19 and in turn pushes back piston 15 sliding in bore 14 while compressing spring 16. From then on piston 15 does not exert any further traction effect on stem 12 via abutment 18, so that valve 11 is freed from the action of return spring 16. The result is that as long as cylinder 6 is under pressure, valve 11 is closed by the pressure, and that as soon as cylinder 6 is evacuated, even slightly, valve 11 will open in order to admit to cylinder 6 hydraulic liquid from chamber 8.

Valve 11 is thus pushed at the end of the suction phase in the closing position by a spring 16 which is selected to exert an energetic return closing force. As soon as the suction phase begins, however, the effect of return spring 16 is cancelled by cam 21, valve 11 then acting as a free valve.

The means through which rod 22 carrying cam 21 is connected to shaft 1 so as to be automatically offset by 180° with respect to the slanting plate 2 are not described in detail since they are identical to those described in the above mentioned U.S. Pat. No. 4,486,152. This means allows reversal of the pump rotation direction.

What is claimed is:

1. A hydraulic pump, which comprises:

a pump housing, the pump housing defining a cylinder and an orifice communicating with the cylinder;

at least one first piston reciprocatingly movable within the cylinder;

a rotatable driving shaft;

means coupled to the driving shaft and the first piston for imparting a reciprocating movement to the first piston in response to rotation of the driving shaft;

valve means for controlling the flow of hydraulic fluid into the cylinder, the valve means including a valve having a valve stem rigidly attached thereto, the valve being selectively positionable in the orifice in an open and closed position, the valve stem including an abutment, the valve means further including a hollow second piston, at least a portion of the valve stem being received by the hollow second piston and slidable therein, the hollow second piston being adapted to engage the abutment to effect movement of the valve from the open position to the closed position, the valve means further including biasing means for biasing the valve in a normally closed position, the biasing means including a spring exerting a force on the second piston to cause the second piston to engage the abutment of the valve stem; and movable cam means coupled to the driving shaft and engagable with the valve means for effecting the disengagement of the second piston by overcoming the force exerted by the spring on the second piston to allow the valve to slidably move within the hollow second piston from the closed position to the open position.

2. A hydraulic pump as defined by claim 1, wherein the means for imparting a reciprocating movement to the first piston includes a slanting plate coupled to the driving shaft; and wherein the hydraulic pump further includes a rod coupled to the driving shaft and to the cam means for effecting movement thereof in response to rotation of the driving shaft, and means permitting offsetting the cam means by 180 degrees with respect to the slanting plate for reversing the pump rotation direction.

3. A hydraulic pump as defined by claim 1, wherein the means for imparting a reciprocating movement to the first piston includes a slanting plate coupled to the driving shaft; and wherein the hydraulic pump further includes a rod coupled to the driving shaft and to the cam means for effecting movement thereof in response to rotation of the driving shaft, and means permitting offsetting the cam means by 180 degrees with respect to the slanting plate for reversing the pump rotation direction.

4. A hydraulic pump as defined by claim 1, wherein the hollow second piston has formed therein a clearance; wherein the valve means further includes a ball received by the clearance; and wherein the cam means engages the ball to effect movement of the second piston.

5. A hydraulic pump as defined by claim 4, wherein the means for imparting a reciprocating movement to the first piston includes a slanting plate coupled to the driving shaft; and wherein the hydraulic pump further includes a rod coupled to the driving shaft and to the cam means for effecting movement thereof in response to rotation of the driving shaft, and means permitting offsetting the cam means by 180 degrees with respect to the slanting plate for reversing the pump rotation direction.

* * * * *